US006006929A

United States Patent [19]

Leonard

[11] Patent Number: 6,006,929

[45] Date of Patent: Dec. 28, 1999

[54] MULTI-DIRECTIONAL HIGH VISIBILITY MERCHANDISING DISPLAY

[75] Inventor: Linda A. Leonard, Redondo Beach, Calif.

[73] Assignee: Olympia Industrial, Inc., City of Industry, Calif.

[21] Appl. No.: 09/162,797

[22] Filed: Sep. 29, 1998

[51] Int. Cl.[6] ..... A47F 5/00

[52] U.S. Cl. ..... 211/113; 211/87.01; 211/118; 211/119; 211/106

[58] Field of Search ..... 211/106, 95, 87.01, 211/113, 118, 119, 85.15, 85.29, 72, 73

[56] References Cited

U.S. PATENT DOCUMENTS

| | | | |
|---|---|---|---|
| 3,167,287 | 1/1965 | Collins | 211/106 X |
| 3,411,735 | 11/1968 | Hurd | 211/113 X |
| 4,817,805 | 4/1989 | Rodriquez | 211/113 X |
| 4,913,297 | 4/1990 | Wells | 211/106 X |
| 5,284,259 | 2/1994 | Conway et al. | 211/73 |
| 5,462,178 | 10/1995 | Wallach et al. | 211/95 |
| 5,505,319 | 4/1996 | Todd | 211/95 |
| 5,588,543 | 12/1996 | Finger | 211/106 X |
| 5,743,403 | 4/1998 | Crysdale | 211/113 X |
| 5,875,901 | 3/1999 | Morrow et al. | 211/113 X |

*Primary Examiner*—Robert W. Gibson, Jr.
*Attorney, Agent, or Firm*—Lackenbach Siegel Marzullo Aronson & Greenspan P.C.

[57] ABSTRACT

A multi-directional high visibility display for exhibiting and merchandising products in a retail establishment includes an elongate back or rear wall and attachment elements, such as clips, for attaching the rear wall of the display to a support structure in a retail establishment. One or more lateral panels are attached to the rear wall and project forwardly thereof to form a surface having surface portions facing in at least two directions which are angularly displaced in relation to an imaginary axis substantially parallel to the length direction of the rear wall. Clip strips can be attached to the lateral panels for removably attaching products on the display. Placement of products on different surface portions renders the products highly visible to people at different vantage points in the retail establishment. The display may be formed of a blank of cardboard or other flexible sheet material or from spaced formed wire frames joined to each other by means of straight rods.

26 Claims, 7 Drawing Sheets

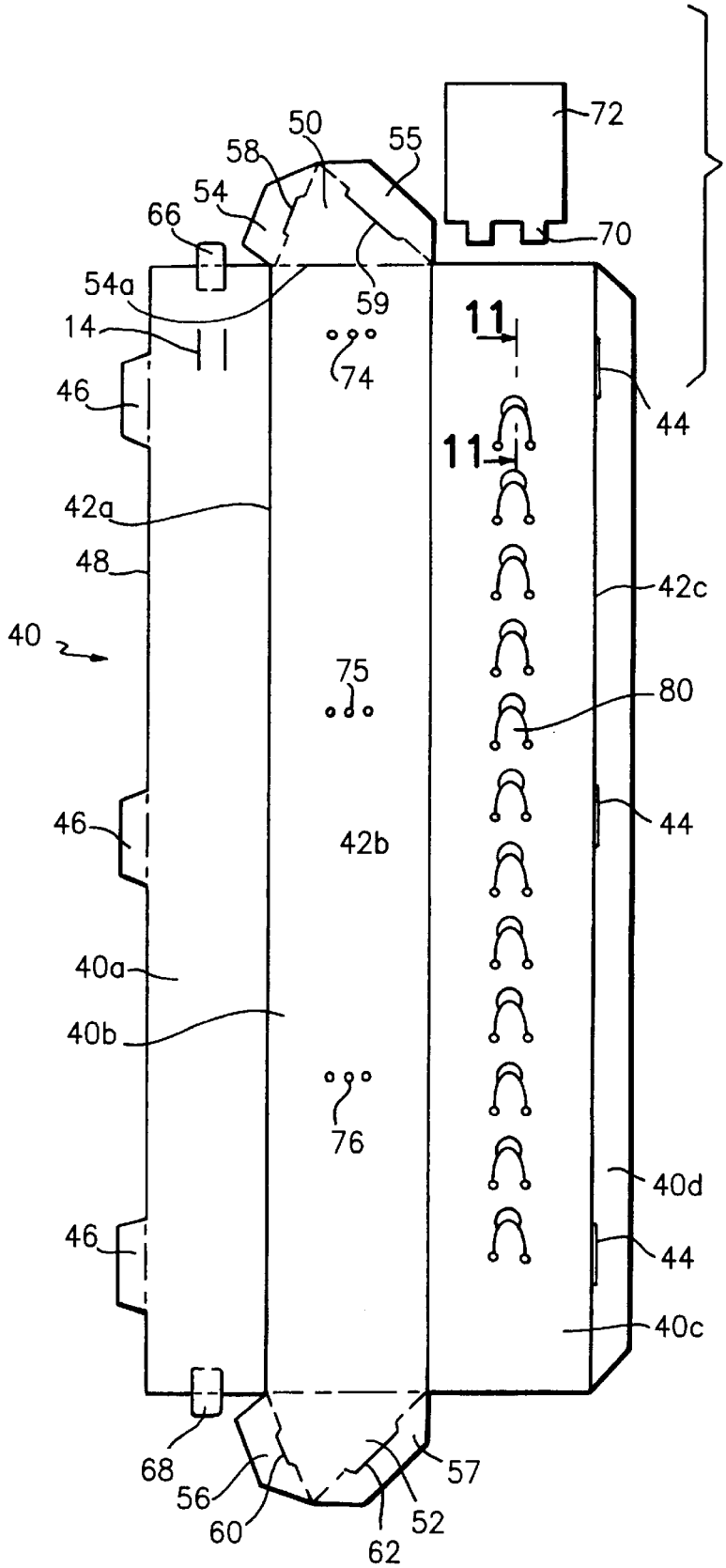
FIG. 10
FIG. 11
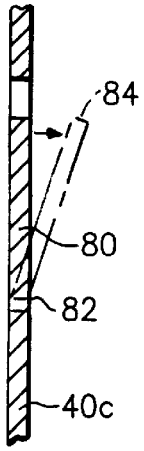

MULTI-DIRECTIONAL HIGH VISIBILITY MERCHANDISING DISPLAY

BACKGROUND OF THE INVENTION

1. Field of the Invention

The present invention generally relates to displays, and, more specifically, to a multi-directional high visibility display for exhibiting and merchandising products in a retail establishment.

2. Description of the Prior Art

A very important, if not critical, factor in the successful merchandising of products is the visibility of the product in a retail establishment. Manufacturers and distributors of products frequently vie for optimum, generally highly trafficked, locations in retail establishments which will expose their product or products to the maximum number of potential purchasers. However, clearly, not all products can be located in prime locations, such as the areas in and around the checkout stations. Of necessity, most products are relegated to being displayed within the main aisles that exist in large retail stores and discount stores and warehouse outlets.

Numerous attempts have been made to maximize the exposure of products within such establishments. Typically, products are mounted on displays that are supported by clips or otherwise, facing a direction substantially perpendicular to the length direction of the aisle. While such displays are preferable to having the product simply placed on shelves, and shoppers who pass through the aisles can better see the products so displayed, the visibility of such products quickly deteriorates as the shopper moves upstream or downstream of the location of the display and the angles of observation in relation to the longitudinal direction of the aisle approach zero.

Other displays have been used which are frequently large, cumbersome and expensive. In most of such instances, the displays are cumbersome to use and inconvenient to store after the retail establishment decides to temporarily or permanently suspends the exhibition of the product(s). This requires the merchant to either store the display, which may be bulky, or to discard a costly piece of equipment.

SUMMARY OF THE INVENTION

Accordingly, it is an object of the present invention to provide a multi-directional high visibility display which does not have the disadvantages inherent in prior art displays.

It is another object of the present invention to provide a display as in the previous object which is simple in construction and economical to manufacture.

It is still another object of the present invention to provide a display of the type under discussion which can be made at a sufficiently low cost to make it practical to make such display disposable after the product(s) on the display have been sold.

It is yet another object of the present invention to provide a multi-directional display which has high visibility in at least two distinct directions, although more than two directions may be provided.

It is a further object of the present invention to provide a high visibility display which is particularly suitable for use in aisles of retail establishments for providing high visibility to products being merchandised for considerable distances upstream and/or downstream of the display.

It is still a further object of the present invention to provide a display which can be formed of an inexpensive blank of flat sheet material that can be quickly and easily be assembled by the merchant.

It is yet a further object of the present invention to provide a display as in the previous objects which can be shipped to merchants with or without product(s) preloaded thereon to thereby require minimum time or effort in mounting the display within a retail establishment.

It is yet a further object of the present invention to provide a multi-directional high visibility display which can be used with strips that are preloaded with products to be displayed and which either be premounted on the displayed or quickly and conveniently attached thereto.

It is an additional object of the present invention to provide a multi-directional high visibility display that can be used not only for conveniently and effectively displaying products in retail establishments, but that can also effectively provide advertising text for the product to be merchandised.

In order to achieve the above objects, as well as others which will become apparent hereinafter, a multi-directional high visibility display in accordance with the present invention for exhibiting and merchandising products in a retail establishment comprises a first member having a pair of spaced opposite substantially parallel edges defining a predetermined direction. First attachment means is provided for attaching said first member to a support structure in the retail establishment to support the first member and orient its edges in a generally vertical direction. A second member is connected to said first member and defines a surface having surface portions facing in at least two directions which are angularly displaced from each other in relation to an imaginary axis substantially parallel to said predetermined direction. Second attachment means is provided for removably attaching products on said second member. In this manner, placement of products on different surface portions defined by said second member renders the products highly visible to people at different vantage points, particularly at points upstream and downstream of the display of an aisle of a retail establishment.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein:

FIG. 10 is a top elevational view of a blank formed of a flat sheet material, such as cardboard, for creating, when assembled, a display of the type shown in FIG. 1;

FIG. 11 is an enlarged cross sectional view of one of the support tabs illustrated in FIG. 10 taken along line 11—11;

DESCRIPTION OF THE PREFERRED EMBODIMENTS

Figure 1:
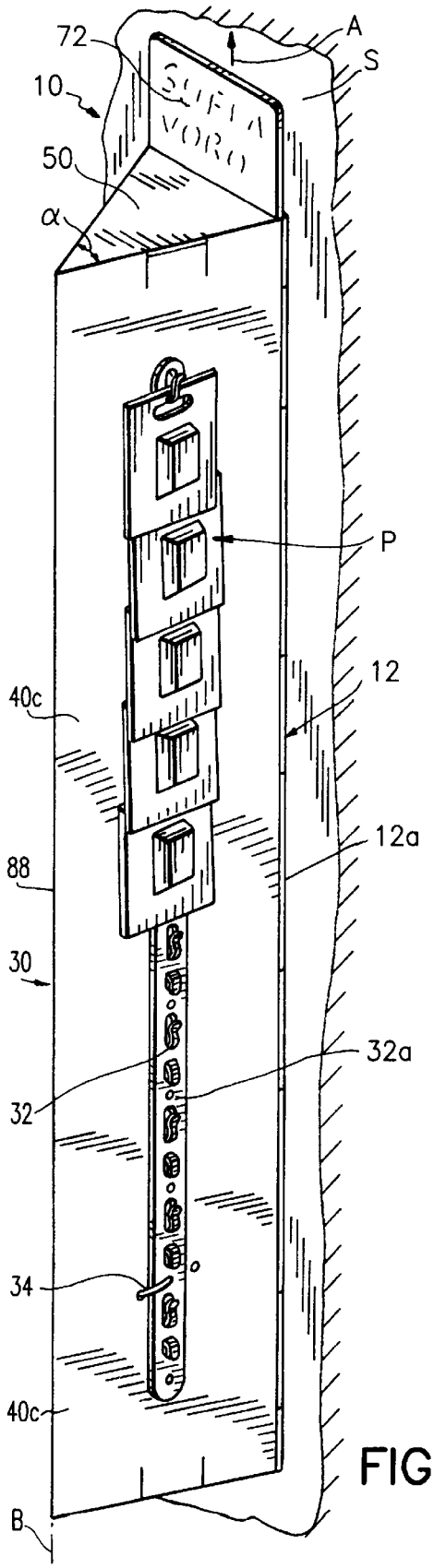
FIG. 1 is a perspective view illustrating a multi-directional high visibility display in accordance with the present invention, mounted on a wall, which serves as a support structure for the display, and showing products attached to a vertical strip of clips attached to one surface of the display.

Referring now specifically to the Figures, in which identical or similar parts are designated by the same reference numerals throughout, and first referring to FIG. 1, a multi-directional high visibility display in accordance with the present invention is generally designated by the reference 10.

Figure 4:
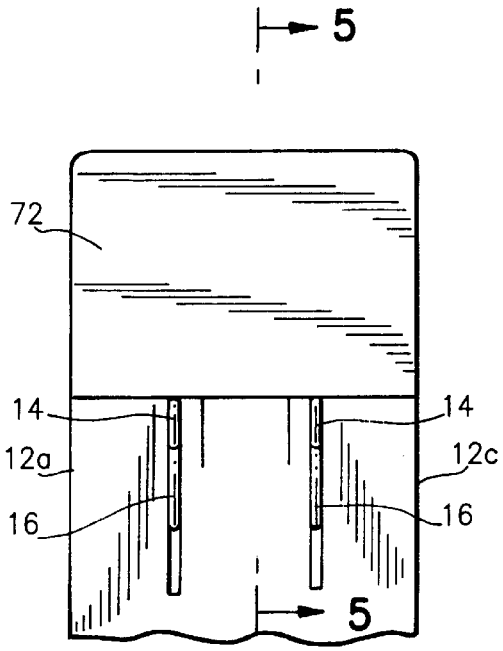
FIG. 4 is an enlarged rear elevational view of the upper end of the display shown in FIG. 1, illustrating the manner in which clips for supporting the display are received within slots or openings on the back wall of the display.
Figure 6:
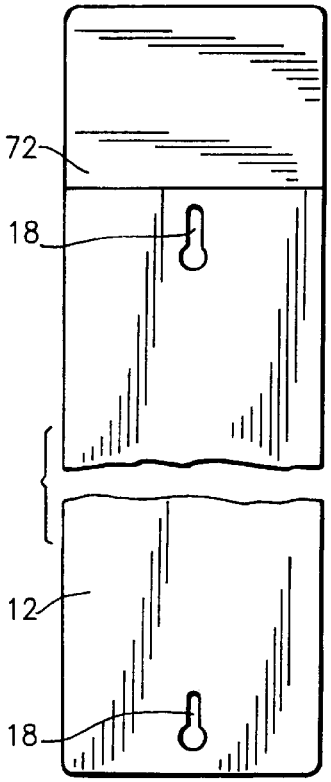
FIG. 6 is a fragmented view, similar to FIG. 4, showing an alternative arrangement for mounting the display on a support structure.

The display 10 includes a first member 12 which has a pair of spaced opposite substantially parallel edges 12*a*, 12*b*, best shown in FIGS. 4 and 6, which define a predetermined direction A. In the embodiment illustrated in FIG. 1, the first member is in the form of a substantially flat rectangular sheet of material in which the edges 12*a*, 12*b* are one of the pair of opposite parallel edges.

Figure 3:
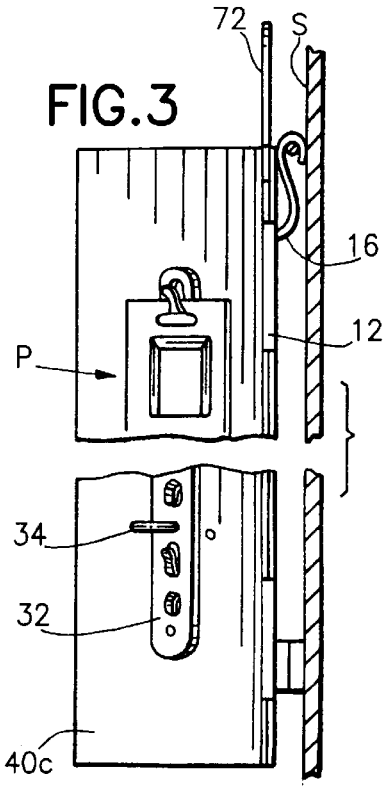
FIG. 3 is a fragmented side elevational view of the display shown in FIG. 1, illustrating the manner in which the upper and lower ends of the display can be secured to the wall or support structure.
Figure 7:
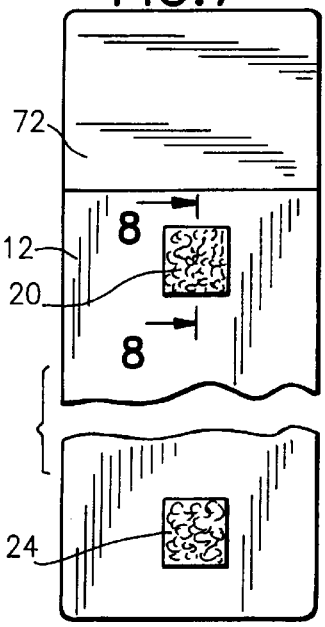
FIG. 7 similar to FIG. 6, and shows another form of attachment of the display on the support structure.
Figure 8:
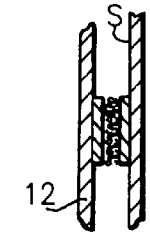
FIG. 8 is a cross sectional view of the attachment mechanism shown in FIG. 7, taken along line 8—8.
Figure 9:
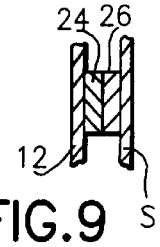
FIG. 9 is similar to FIG. 8 but illustrates a still other form of attachment mechanism of the display to the support structures.

The rectangular panel 12 may be provided with various or numerous means for attaching the back wall or rear panel 12 to a support structure or surface S in a retail establishment, such as a wall, an aisle shelf, or the like, to support the back wall or panel 12 so as to orient the edges 12*a*, 12*b* of the rear wall of the panel in a generally vertical direction as shown. In FIG. 4, the rear wall or panel 12 is shown to be provided spaced substantially elongate slots 14 through which clips 16 may be inserted to enable the back wall to be supported on the structure or surface S as best shown in FIG. 3. In FIG. 6, the elongate slots 14 have been replaced by keyhole slots, two such slots 18, 18' being provided at both the upper and lower ends of the rear wall or panel 12. However, it will be clear that numerous other approaches may be used, some of which are illustrated in FIGS. 7–9. In FIGS. 7 and 8, the rear wall 12 is shown with a section of "hook" or "loop" tape 20 which, in FIG. 8, is illustrated to be attached to the complementary "hook" or "loop" tape 22 secured to the support structure S. Such hook and loop tape is frequently marketed under the brand name or trademark "VELCRO". In FIG. 9, tapes 24 and 26 are illustrated which can be of the self-adhesive type that can be used as mounting pads.

In accordance with the broader aspects of the present invention, a second member, generally designated by the reference numeral 30 in FIG. 1, is connected to or otherwise mounted on the first member or the rear wall in panel 12 in the embodiment shown, which creates a surface having surface portions facing at least two directions which are angularly displaced from each other in relation to an imaginary axis B which is substantially parallel to the edges 12*a*, 12*b* and the direction A. As will be discussed in connection with FIGS. 12–14, such second member 30 can be variously configured to provide the benefits and advantages of the present invention, with different degrees of advantage, while providing the flexibility that may be desired or necessary to adequately and effectively display a product to be merchandised.

In the embodiment 10, shown in FIGS. 1–5, the second member is in the form of two inclined or angularly offset walls or panels formed of flat sheet material. A second attachment mechanism is provided for removably attaching products P on the second member 30. In the embodiment shown, such attachment means is in the form of an elongate carrier strip 32 provided with a series of spaced clips 32*a* and a plurality of spaced holes 32*b* between selected clips 32*a* which may be suitably used to attach to the second member 30 by means of any conventional means, such as flexible wire ties 34. The carrier strips 32 may be of the type distributed by Olympia Industrial, Inc., the assignee of the present invention, used to display primarily carded products. The carrier strips 32 are frequently shipped with product pre-loaded on them so that a merchant may simply remove the loaded strip from a package of strips and simply attach it to a support structure within the establishment by means of a hook or the like. These strips are generally disposable and require minimal effort or time to mount the same in a variety of different locations within a retail establishment.

Figure 2:
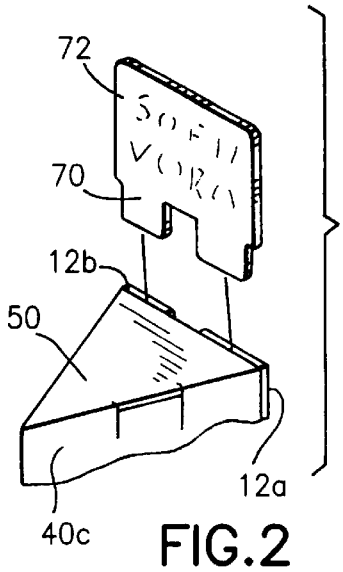
FIG. 2 is a fragmented view of the upper end of the display shown in FIG. 1, illustrating the manner in which an advertising display panel may be removed or inserted into the display.

Referring also to FIGS. 10 and 11, a presently preferred embodiment 10 of the present invention is formed of a folded flat blank of sheet material 40, such as cardboard or plastic. In FIG. 10, the blank 40 includes four substantially elongate and parallel panels 40*a*–40*d*, separated by substantially parallel spaced fold lines 42*a*–42*c*. A relatively narrow panel 40*d* is provided to enable the formation of spaced slots 44, arranged along the fold line 42*c*, and dimensioned to frictionally receive locking tabs 46 arranged along the edge 48. An upper triangular portion 50 and a corresponding lower triangular portion 52 are formed at the upper and lower ends of the panel 40*b*, a fold line 54*a* and fold line 54*b* being provided to enable the triangular panels 50 and 52 to be folded into a plane substantially normal to the plane of the panel 40*b*. Additional narrow tabs 54–57 are provided, which can be folded to positions normal to the triangular panels 50, 52, to enable the formation of slots 58–62 for receiving the tabs. The slots 58 and 60 are arranged to receive locking tabs 66 and 68. The tab 59 is arranged to receive the tabs 70 of a flat panel 72 suitable for being imprinted with advertising text, as best illustrated in FIGS. 1 and 2.

The panel 40*a* in FIG. 10 illustrates the slots 14 for mounting the back wall on a support structure. The panel 40*b* and panel 40*c* are shown with two different forms of attaching means for securing product to these two panels. The panel 40*b* is provided with three rows of holes 74–76 which are spaced from each other along the direction A of the fold lines 42*a*–42*c*. It will be understood that the edge 48 and the fold line 42*a* become converted to the edges 12*a*, 12*b* of the rear wall 12in the assembled unit. The holes 74–76 are suitable for receiving a flexible tie therethrough which can be used to attach or secure the carrier strip 32 to the panel 40*b*. Clearly, the number of rows of holes is not critical, and any number of sets of holes may be used, as necessary. Thus, for example, when the product is lightweight or the sheet material forming the panel 40 is heavy or strong, fewer sets of holes need to be provided. However, if the product on the carrier strip is heavy or the sheet material from which the device is formed is not that strong, it is preferable to use a greater number of sets of holes and a greater number of ties to provide adequate support for the carrier strip and the attached product.

Still referring to FIG. 10, the panel 40*c* is provided with a vertical column of die cut tabs 80, the details of which are best shown in FIG. 11. Each die cut tab 80 may be moved out the plane of the panel about any suitable connected portion which has not been die cut to form a plastic hinge as at 82, to be positionable as suggested at 84 in phantom outline. Once the tab 80 has been moved to the position shown, such tab can also be used to support product, particularly carded products provided with a suitable slots or mounting on a pegboard or other similar support device. While the holes 74, 76, suitable for mounting of a carrier strip 32, are shown in conjunction with the panel 40*b*, and die cut tabs 80 are shown in panel 40*c*, it will be clear to those skilled in the art that any combination of such attachment means may be used. Thus, the holes for carrier strips may be provided on both panels 40*b*, 40*c*. The mounting mechanisms can be mixed as shown in FIG. 10 or any other suitable or appropriate method for mounting products on such panels may likewise be used.

Figure 5:
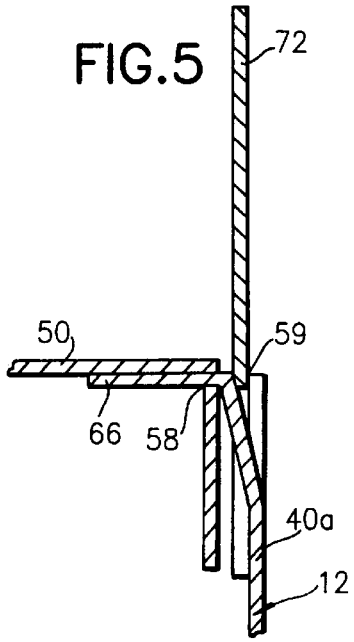
FIG. 5 is a cross sectional view of the upper end of the display shown in FIG. 4, taken along line 5—5.

The details of the manner in which the advertising panel 72 is received within the slot 59 for being supported is illustrated in FIG. 5. In FIG. 2, the panel is illustrated in the process of being inserted into the slot or removed therefrom after the unit 10 has been fully assembled from the blank 40.

Figure 12:
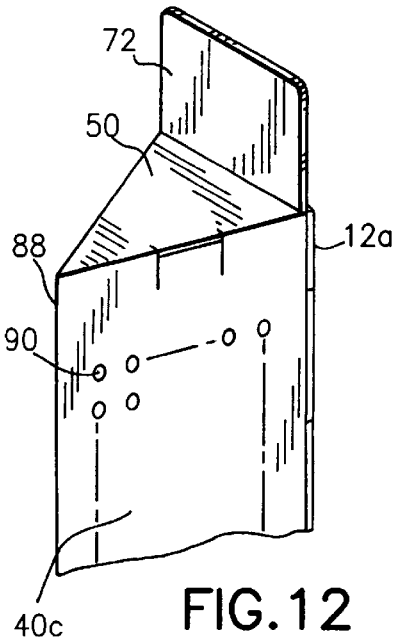
FIG. 12 is similar to FIG. 2 but illustrates an array of holes for attachment of products to the display surfaces.

An important feature of the present invention is that the second member 30 may be multiply configured to suit a wide range of applications. Thus, with the embodiment of FIGS. 1–12, the second member 30 is formed of two generally flat, angularly offset surfaces, corresponding to panels 40*b*, 40*c* in the blank of FIG. 10, which define a predetermined angle $\alpha$, shown in FIG. 1, where the flat surfaces intersect along the apex, tip or edge 88 remote from the back wall or rear panel 12 to define a generally cylindrical structure having a substantially uniform triangle cross section along the direction A. The angle a can be any suitable or desired value. Thus, the angle a can be less than 90° or can be greater than 90°. In the embodiment illustrated, the angle $\alpha$ is equal to approximately 45°. This configuration is also shown in FIG. 12, in which the panel 40*c* is illustrated as being provided with an array of holes 90 suitable for receiving wire pegs of the type frequently used in retail establishments for hanging products on a horizontal surface or pegboard.

Figure 13:
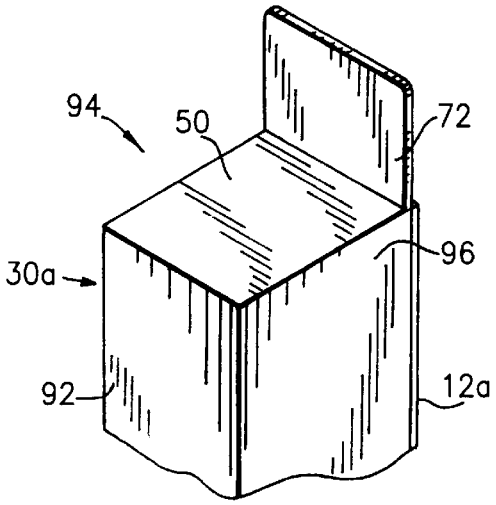
FIG. 13 is similar to FIG. 12, but illustrating a square instead of a triangular configuration of the display.

In FIG. 13, an alternate embodiment is illustrated, in which the second member 30*a* is formed of three generally flat surfaces each of which is substantially parallel to the edges 12*a*, 12*b* of the back wall or panel 12. The front panel 92, which is most remote from the rear panel or wall 12, is substantially parallel to the rear panel or wall, while the two lateral surfaces 94, 96 are each parallel to each other and substantially normal to the front panel 42 and to the rear panel or wall 12. This design defines a cylindrical structure having a substantially uniform rectangular cross section. With this arrangement, the front panel 92 as well as the lateral panels 94, 96 may each be used to mount or support product as suggested in FIGS. 1, 3 and 12. However, if desired, the front panel 92 may also be used solely for advertising text, or other information useful to a potential purchaser.

Figure 14:
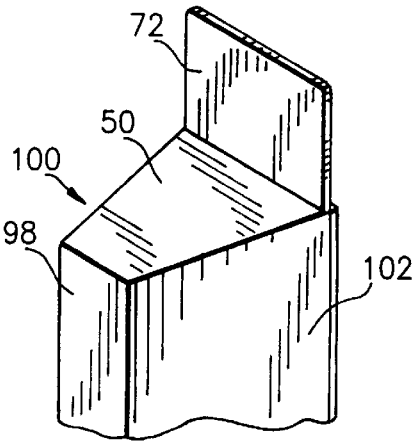
FIG. 14 is similar to FIGS. 12 and 13, but illustrating a still further embodiment having a trapezoidal other configuration for the display.

A variation of the embodiments described thus far is illustrated in FIG. 14, in which one of the surfaces 98 most remote from the back wall or rear panel 12 is substantially parallel to that rear wall or panel, while each of the two remaining surfaces 100, 102 are inwardly directed from one of the edges 12*a*, 12*b* to the lines of intersection with the front panel 98 to define a cylindrical structure having a substantially uniform trapezoidal cross section with the widest base at the rear panel or wall 12 and the narrow base most remote from that wall. Here, again, the front panel 98 may be used to support product although the area for that purpose is clearly more limited than the surface area provided on the front panel 92 in FIG. 13. However, the lateral panels 100, 102 are also inclined as in the case of the embodiment 10 shown in FIG. 1. The inclined panels of the types shown in FIGS. 1 and 14 are generally more useful in displaying the product at greater distances away from the display, inasmuch of the panels 94, 96, which face directions parallel to the direction of the aisle, may more easily be blocked by other obstructions which are positioned at, on or proximate to the shelves in the aisles.

Figure 15:
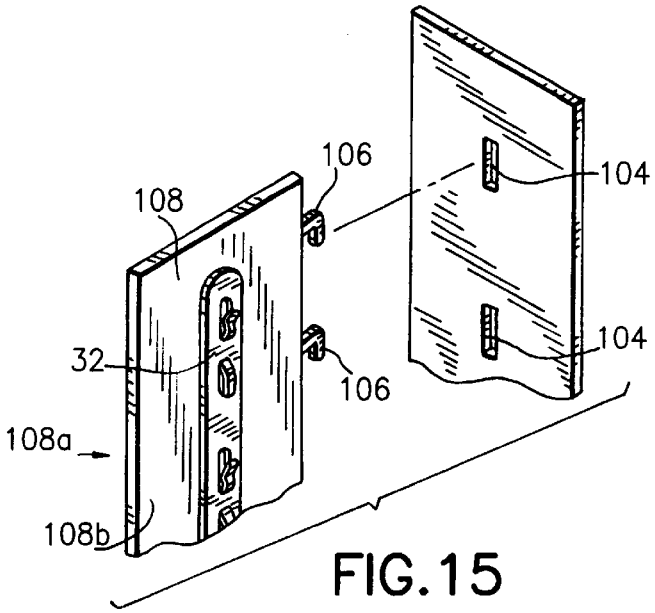

In FIG. 15, the rear wall or panel 12 is shown to be provided with slots 104 which are dimensioned and configured to receive L-shaped retainer hooks 106 projecting from the edge of a support panel 108 which comprises the second member. The support panel 108 also exhibits surfaces 108*a* and 108*b* which face in opposite directions substantially parallel to the plane of the rear wall 12, as with the case of the lateral panels 94, 96 of the embodiment shown in FIG. 13. FIG. 15 also illustrates a carrier strip 32 mounted on the surface 108*b*. Because the embodiment shown in FIG. 15 is not formed from a blank of sheet material, it may be more appropriately formed of more rigid or stiffer materials, such as wood, plastic or heavy cardboard. The embodiment in FIG. 15, while it can be used to achieve at least some of the advantages of the present invention, is inherently structurally weaker than the solid configurations shown in FIGS. 1–14, in which the blank, once assembled, attains structural rigidity and integrity, and does not readily deform. The support panel 108 in FIG. 15, on the other hand, is susceptible to undesired movements about the hooks 106 when the product is removed from the panel 108.

Figure 16:
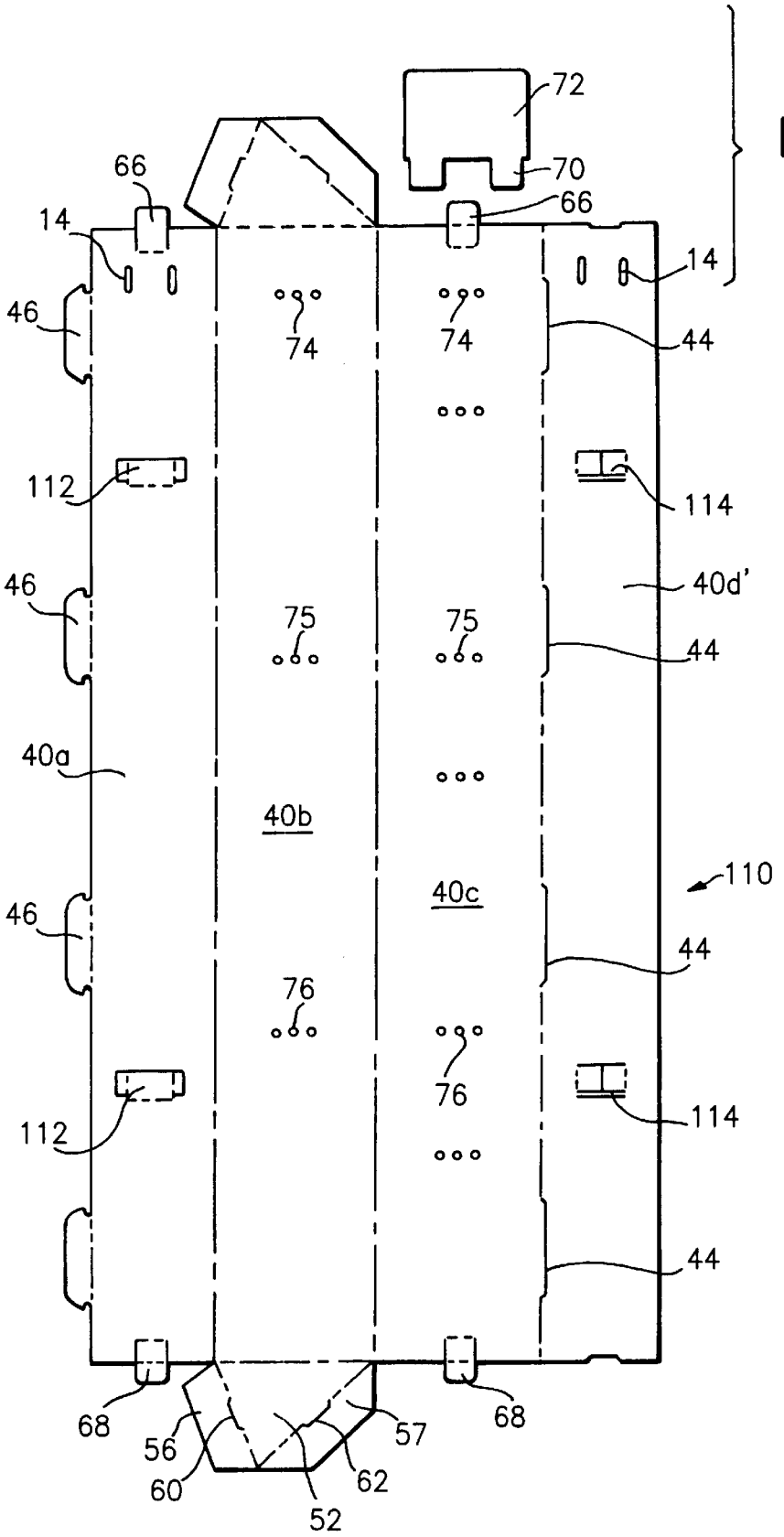
FIG. 16 is similar to FIG. 10 but illustrates a modification of the blank which provides a double wall on the rear of the display to support heavier weight products.

Referring to FIG. 16, a blank 110 is illustrated which varies from the blank shown in FIG. 10 primarily in that the narrow panel 40*d* is replaced a panel 40*d*' which has a width substantially greater than the width of the panel 40*d*, and preferably has substantially the same width as the panel 40*a*. With this construction, once the blank is formed into the display, the panels 40*a* and 40*d*' are essentially coextensive and abut against each other to provide a double thickness rear wall or panel. The double thickness at the rear of the device provides twice the strength and twice the weight bearing capacity since the support clips 16 are now capable of extending through the slots 14 in both of the panels of the rear walls instead of just one, as in the case of the blank shown in FIG. 10. In other respects, the blank 110 is similar to the blank 40, with the exception that additional locking tabs 112 are optionally provided dimensioned and configured to be frictionally received within slots or openings 114 in order to better secure the panels 40*a*, 40*d*' to each other and to provide a more rigid and reliable structure that can be used with larger and heavier products.

Figure 17:
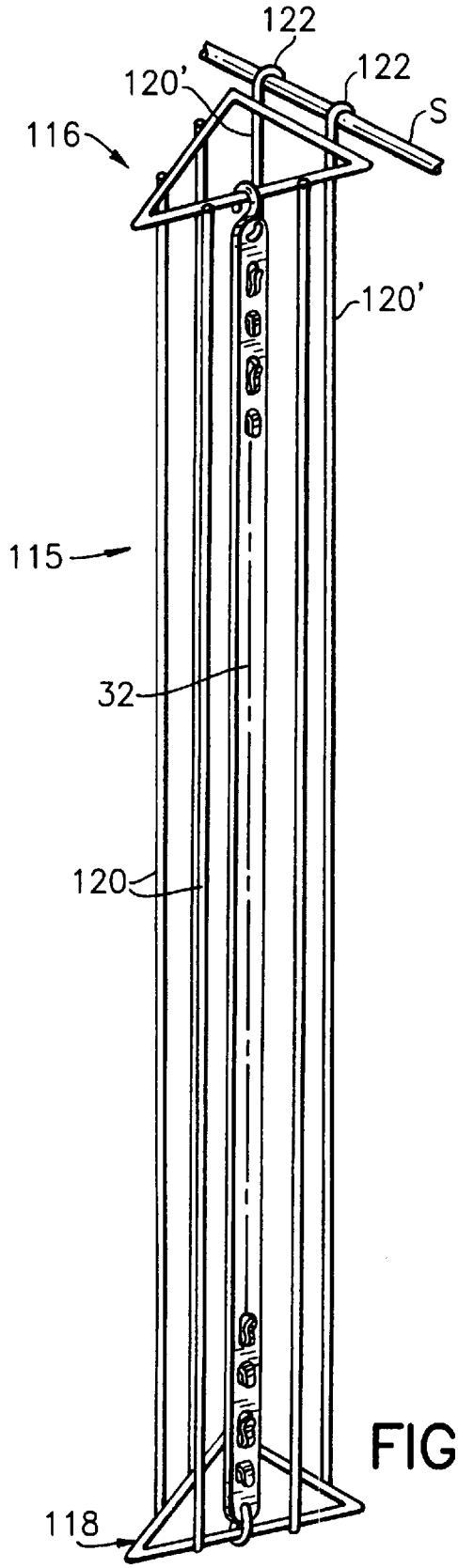
FIG. 17 is a perspective view, similar to FIG. 1 but illustrating the display device formed of two upper and lower spaced triangular frames joined by substantially vertical rods.

In FIG. 17, a still further embodiment 115 of the invention is illustrated in which the display device is formed of similarly shaped frames 116, 118 which are spaced from each other along the predetermined direction A. Here, both the first and second members forming the rear wall of the display as well as the two lateral walls are in turn formed of elongate rods 120 which extend between the upper and lower frames. While the frames 116, 118 are shown to be triangular in FIGS. 17 and 18, to correspond to the configuration shown, for example, in FIG. 1, it should be clear that the frames 116 and 118 can easily be changed to have different configurations to correspond to the square embodiment shown in FIG. 13 and the trapezoidal embodiment shown in FIG. 14. The embodiment 115 can be attached in any suitable manner in a retail establishment. In FIG. 17, the rods 120' forming the rear surface of the device extend above the frame 116 and are downwardly curved to form hooks 122 that may be used to support the device on a suitable support structure. The lateral wire portions 116*a*, 116*b* may be used to support hooks (not shown) or ties 34 for supporting the carrier strips 32.

Figure 18:
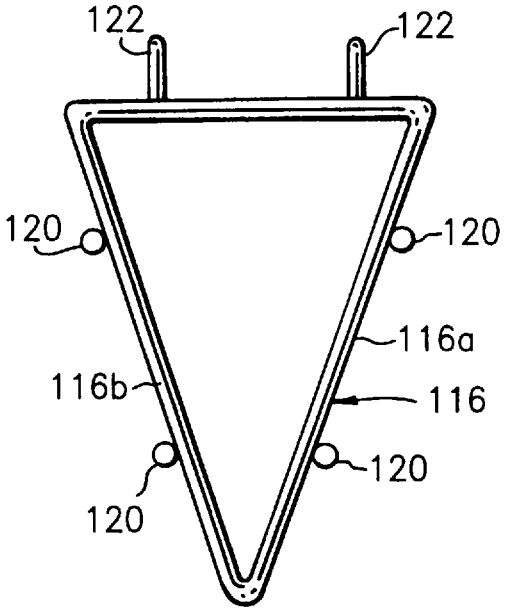
FIG. 18 is an enlarged top plan view of the triangular frame shown in FIG. 17.
Figure 19:
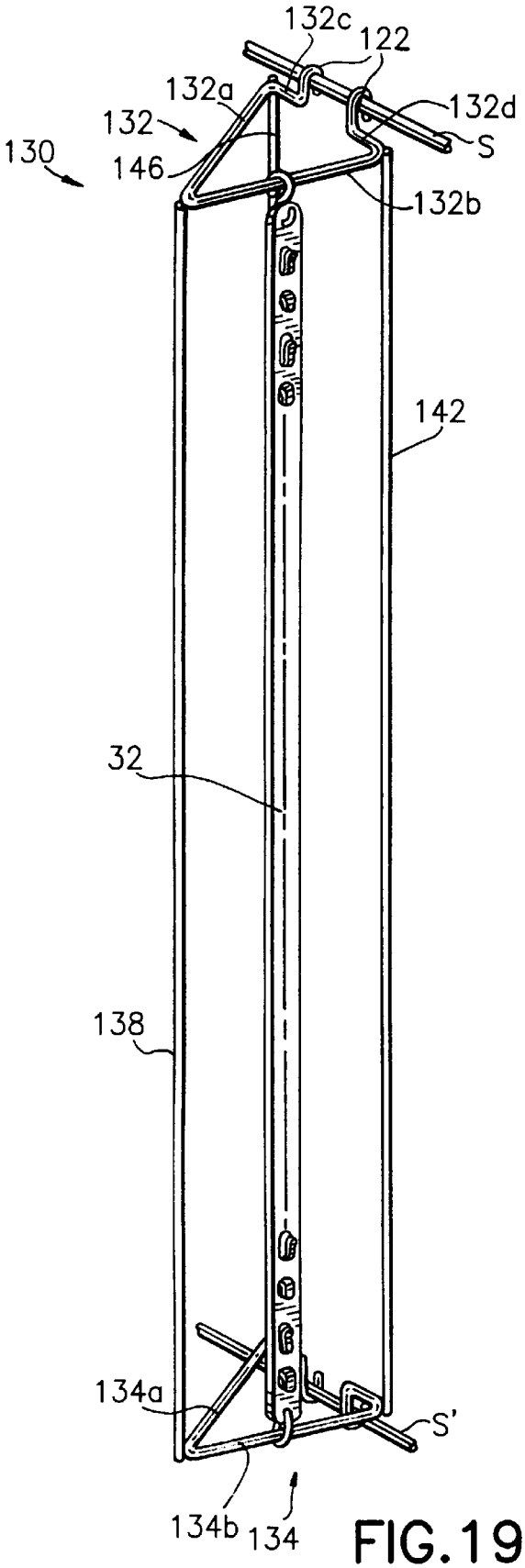
FIG. 19 s similar to FIG. 17, but showing an alternate embodiment in which the hooks for mounting the display are formed from the upper and lower triangular frame member.
Figure 20:
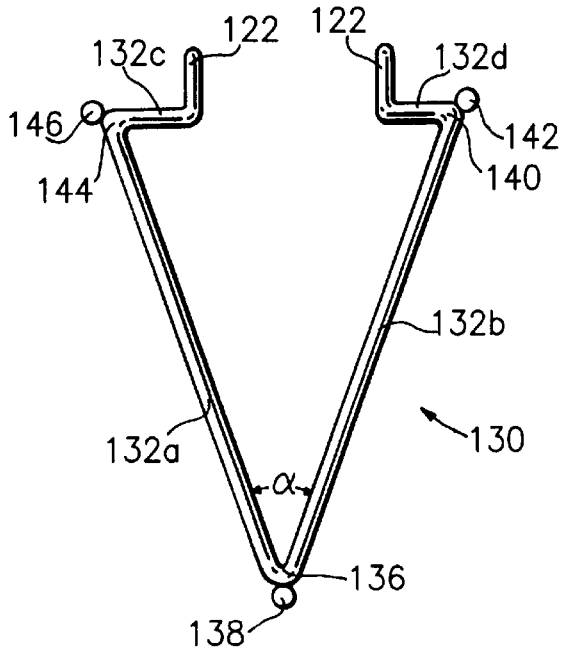
FIG. 20 is similar to FIG. 18, but showing a top plan view of the display device shown in FIG. 19.

Referring to FIGS. 19 and 20, an alternate embodiment of the display shown in 6, 17 and 18 is shown and designated by the reference number 130. The display device 130 is made up of five distinct wire elements, whereas the embodiment of FIGS. 17 and 18 is made up of eight wire elements. The display 130 includes an upper triangular frame member 132 and a lower triangular frame member 134. The upper triangular frame member 132 includes wire portions 132*a* and 132*b* which are bent in relation to each other to define the angle α while the portions 132*c* and 132*d* are bent as shown from the portions 132*a*, 132*b*, respectively, and are subsequently bent to create the mounting or supporting hooks 122. The lower triangular frame member 134 is similarly formed. To the apex 136 formed by the portions 132*a*, 132*b*, there is attached, such as by welding, a vertical rod or wire member 138. Similarly, to the apex 140, formed by the portions 132*b*, 132*ds,* there is attached by welding a vertical rod 142 and to the apex 144 formed by the portions 132*a*, 132*c*, there is welded a vertical rod 146. Therefore, while functionally similar to the display 115, the display 130 is less expensive to manufacture and weighs less than its previously described counterpart.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What I claim is:

1. A multi-directional high visibility display for exhibiting and merchandising products in a retail establishment, comprising a first elongate member defining a predetermined direction having a pair of spaced edges arranged in a mounting plane; first attachment means for attaching said first member to a support structure in the retail establishment to support said first member and orient said edges in a generally vertical direction; a second elongate member connected to said first elongate member and defining a surface having surface portions facing at least two directions which are angularly displaced from each other, at least one of said surface portions being arranged in a plane which is not parallel to said mounting plane; and second attachment means for removably attaching products on said second member, whereby placement of products on different surface portions defined by said second member renders the products highly visible to people at different vantage points in the retail establishment.

2. A display as defined in claim 1, wherein said elongate members are formed of a folded flat blank of sheet material.

3. A display as defined in claim 2, wherein said blank is formed of cardboard.

4. A display as defined in claim 2, further comprising locking tabs and slots on said blank for receiving said locking tabs when said blank is assembled to form the display.

5. A display as defined in claim 2, wherein said blank has two panels that form said first elongate member with a double thickness of sheet material.

6. A display as defined in claim 2, wherein said second elongate member is provided with an array of holes suitably aligned to secure at least one elongate strip of spaced attachment means.

7. A display as defined in claim 6, wherein said second attachment means are in the form of hooks spaced along said elongate strip suitable for removably supporting the products to be displayed.

8. A display as defined in claim 6, wherein a plurality of flexible ties are used to secure said at least one strip to said second elongate member by looping said ties through said holes and said at least one strip.

9. A display as defined in claim 2, wherein said first elongate member comprises said sheet material formed with at least one aperture at one longitudinal end of said first elongate member, and said first attachment means comprises at least one hook configured to engage said elongate first member by passage through said at least one aperture and to engage the support structure in the retail establishment.

10. A display as defined in claim 9, further comprising third attachment means for securing the other longitudinal end of said first elongate member against movement when the display is supported by said first attachment means.

11. A display as defined in claim 10, wherein said third attachment means comprises hook and loop tape respectively placed on opposing surfaces of said first member and a proximate surface in the retail establishment.

12. A display as defined in claim 2, wherein said second attachment means comprises tabs die cut in said sheet material that can be moved out of the plane defining said sheet material for engaging the products to be displayed.

13. A display as defined in claim 1, wherein said second elongate member is formed of two generally flat intersecting surfaces substantially parallel to said predetermined direction and defining a predetermined angle α where said flat surfaces intersect at a point remote from said first elongate member to define a cylindrical structure having a substantially uniform triangular cross section.

14. A display as defined in claim 13, wherein said angle α is less than 90°.

15. A display as defined in claim 14, wherein said angle α is equal to approximately 45°.

16. A display as defined in claim 13, wherein said angle α is greater than 90°.

17. A display as defined in claim 1, wherein said second elongate member is formed of three generally flat surfaces substantially parallel to said predetermined direction, one of said surfaces being substantially parallel to said mounting plane, and said remaining two surfaces being substantially parallel to each other and substantially normal to said mounting plane to define a cylindrical structure having a substantially uniform rectangular cross section.

18. A display as defined in claim 1, wherein said second elongate member is formed of three generally flat surfaces substantially parallel to said predetermined direction, one of said surfaces being most remote from said first member being substantially parallel to said mounting plane, and said remaining two surfaces each being inwardly directed from one fo said edges to the lines of intersection with said one of said surfaces to define a cylindrical structure having a substantially uniform trapezoidal cross section with the widest base at said first elongate member and the narrow base most remote from said first elongate member.

19. A display as defined in claim 1, wherein said first and second elongate members are formed of similarly shaped frames spaced from each other along said predetermined direction, said first and second members elongate being formed of elongate rods extending between said frames.

20. A display according to claim 19, wherein said frames are triangular.

21. A display as defined in claim 1, in combination with products pre-mounted on said second elongate member, whereby a merchant can immediately display the products by causing the display to be supported by means of said first attachment means without assembly or loading of products.

22. A display according to claim 1, wherein said second attachment means comprises holes on said second member suitable for supporting wire pegs.

23. A display according to claim 1, further comprising a panel mountable on said members suitable for bearing advertising text.

24. A display according to claim 23, wherein said panel is mounted to be substantially coplanar with said first elongate member.

25. A display according to claim 1, wherein said first elongate member defines a plane containing said substantially parallel edges, and said second elongate member comprises a substantially flat panel arranged on said first elongate member in a plane substantially normal to said plane of said first elongate member, whereby said second member forms two surfaces for supporting products which are directed in opposing directions generally parallel to said mounting plane.

26. A display according to claim 19, wherein each spaced frame is made of an elongate rodlike member bent to form a substantially closed polygon with a space or gap in one of the sides to form proximate free ends, said first attachment means comprising hooks bent at said free ends, said elongate rods forming said first and second elongate members extending between associated vertices of same frames.

* * * * *